US009486063B2

(12) United States Patent
Roman

(10) Patent No.: US 9,486,063 B2
(45) Date of Patent: Nov. 8, 2016

(54) PAINT APPLICATION ASSEMBLY

(71) Applicant: Jose Roman, Manchester, CT (US)

(72) Inventor: Jose Roman, Manchester, CT (US)

( * ) Notice: Subject to any disclaimer, the term of this patent is extended or adjusted under 35 U.S.C. 154(b) by 0 days.

(21) Appl. No.: 14/633,259

(22) Filed: Feb. 27, 2015

(65) Prior Publication Data

US 2016/0249734 A1 Sep. 1, 2016

(51) Int. Cl.

| | |
|---|---|
| ***A46B 11/00*** | (2006.01) |
| ***A46B 11/06*** | (2006.01) |
| ***B05C 17/005*** | (2006.01) |

(52) U.S. Cl.

CPC ..... *A46B 11/06* (2013.01); *B05C 17/00573* (2013.01)

(58) Field of Classification Search

CPC combination set(s) only.
See application file for complete search history.

(56) References Cited

U.S. PATENT DOCUMENTS

| | | | | |
|---|---|---|---|---|
| 2,041,173 | A * | 5/1936 | Fairchild | A46B 11/0027 239/565 |
| 3,020,579 | A * | 2/1962 | O'Connor | B05C 17/00 118/410 |
| 3,640,630 | A * | 2/1972 | Walker | A46B 11/063 401/188 R |
| 3,676,010 | A * | 7/1972 | Kirch | B05C 17/002 401/188 R |
| 3,776,645 | A * | 12/1973 | Walker | A46B 11/063 401/188 R |
| 5,248,089 | A | 9/1993 | Bekius | |
| D355,297 | S | 2/1995 | Ash, Jr. | |
| 7,044,343 | B2 * | 5/2006 | Anue | A45F 3/16 210/257.1 |
| 2006/0120794 | A1 | 6/2006 | Scott et al. | |
| 2012/0031906 | A1 | 2/2012 | Ord | |
| 2013/0114990 | A1 | 5/2013 | Sandahl et al. | |

* cited by examiner

*Primary Examiner* — David Walczak

(57) ABSTRACT

A paint application assembly includes a backpack that has a back side and a bottom side and the back pack includes a pair of straps coupled to the backpack and a belt coupled to the backpack. The straps are positioned on the back side to be looped over shoulders of a user so the backpack is retained on a back of the user. The belt is positioned on the bottom side and the belt may be wrapped around a waist of the user. A paint application apparatus is coupled to the backpack to contain and selectively dispense a paint.

2 Claims, 3 Drawing Sheets

PAINT APPLICATION ASSEMBLY

BACKGROUND OF THE DISCLOSURE

Field of the Disclosure

The disclosure relates to paint devices and more particularly pertains to a new paint device for containing a paint and applying the paint to a surface.

SUMMARY OF THE DISCLOSURE

An embodiment of the disclosure meets the needs presented above by generally comprising a backpack that has a back side and a bottom side and the back pack includes a pair of straps coupled to the backpack and a belt coupled to the backpack. The straps are positioned on the back side to be looped over shoulders of a user so the backpack is retained on a back of the user. The belt is positioned on the bottom side and the belt may be wrapped around a waist of the user. A paint application apparatus is coupled to the backpack to contain and selectively dispense a paint.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
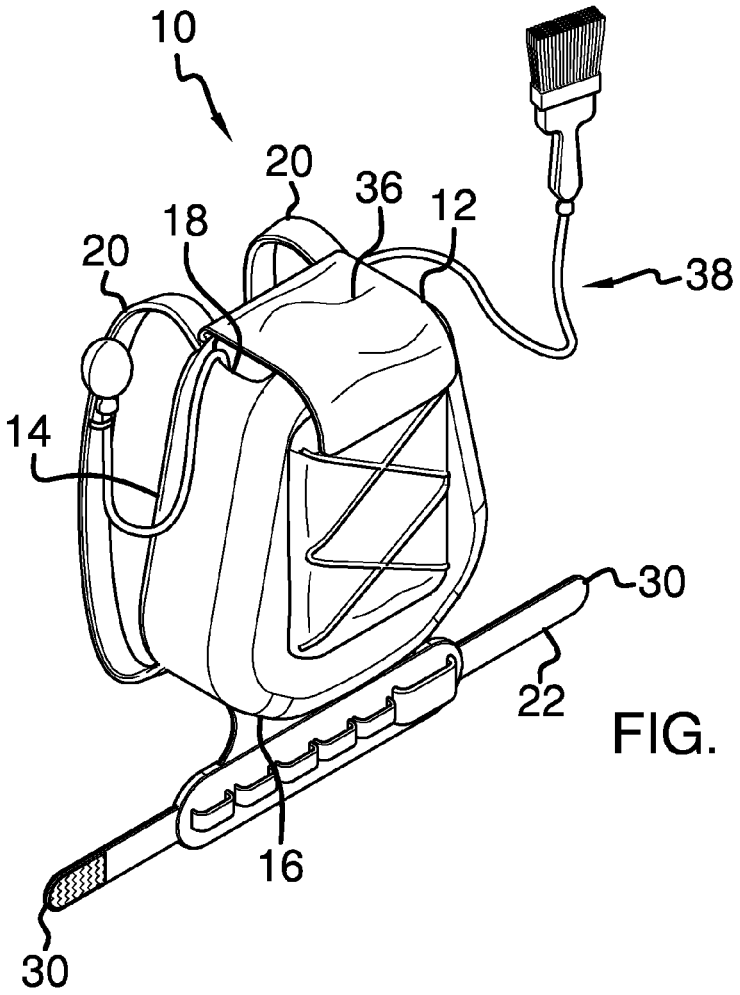
FIG. 1 is a perspective view of a paint application assembly according to an embodiment of the disclosure.
Figure 2:
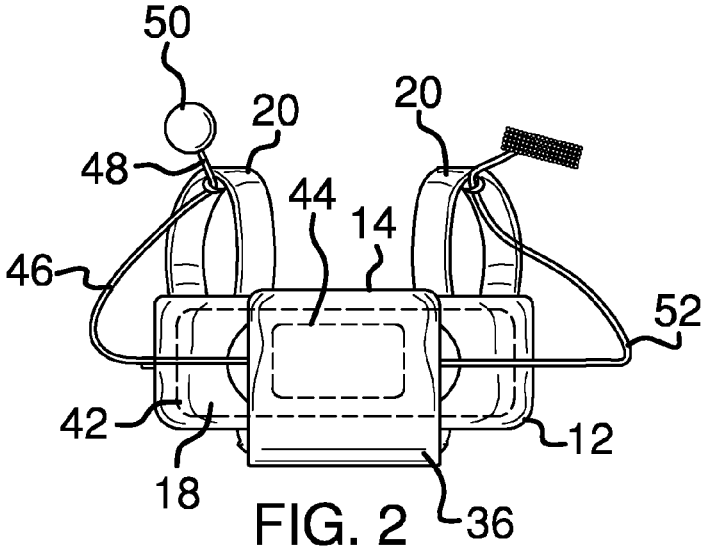
FIG. 2 is a top view of an embodiment of the disclosure.
Figure 3:
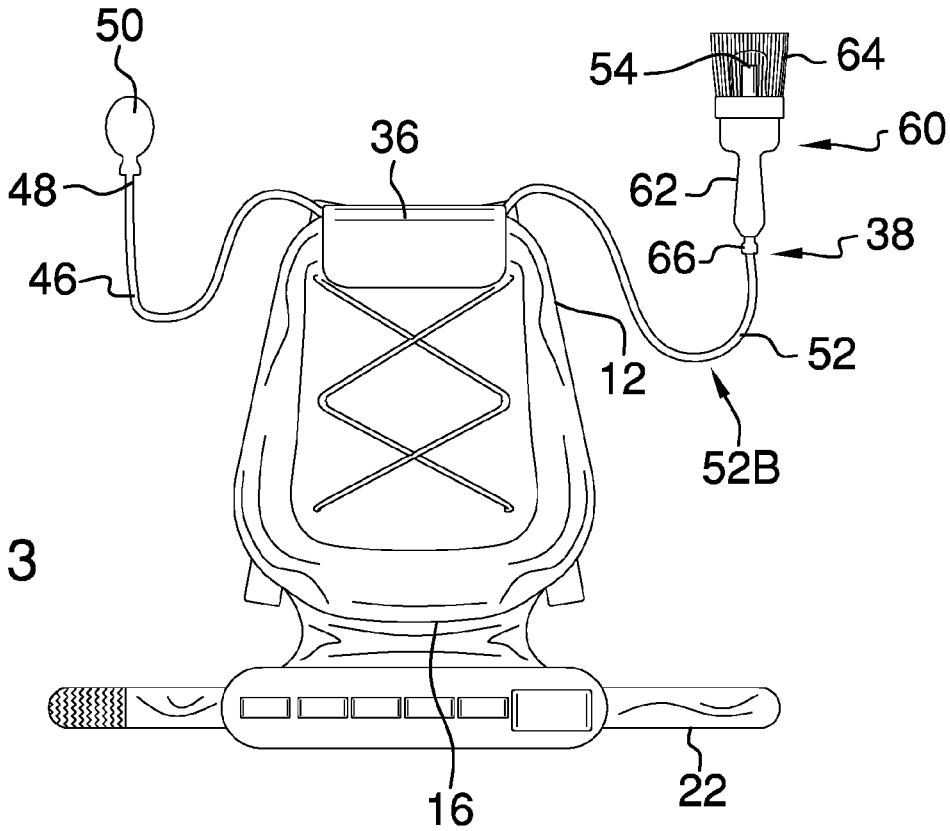
FIG. 3 is a front view of an embodiment of the disclosure.
Figure 4:
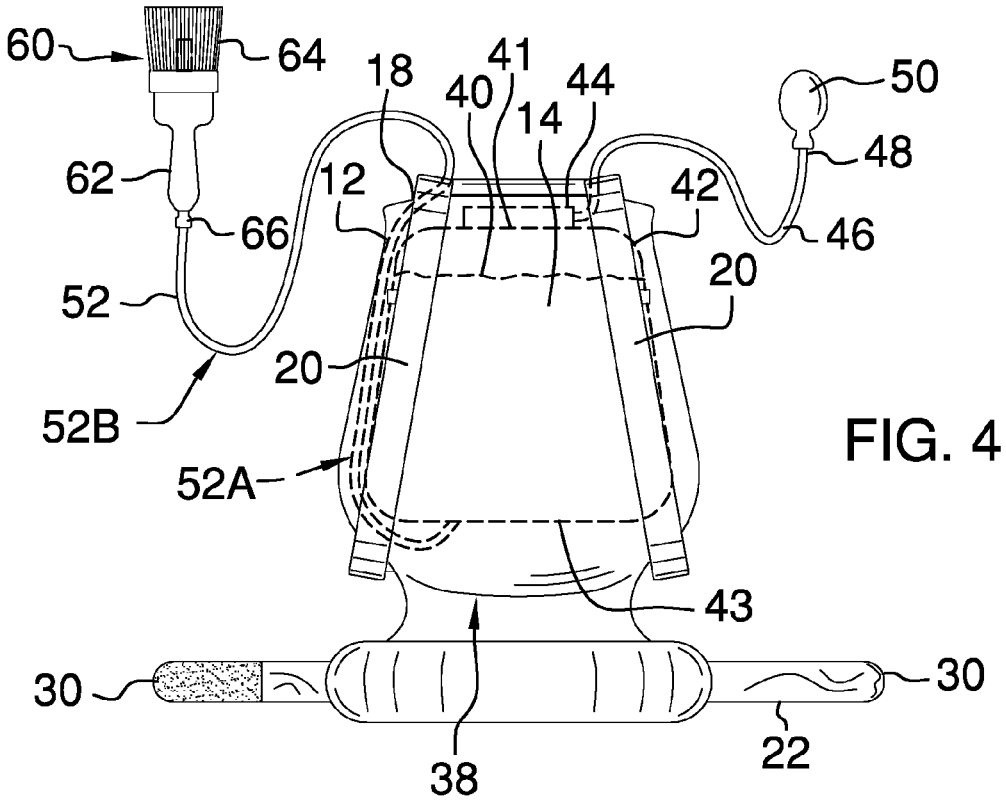
FIG. 4 is a back view of an embodiment of the disclosure.
Figure 5:
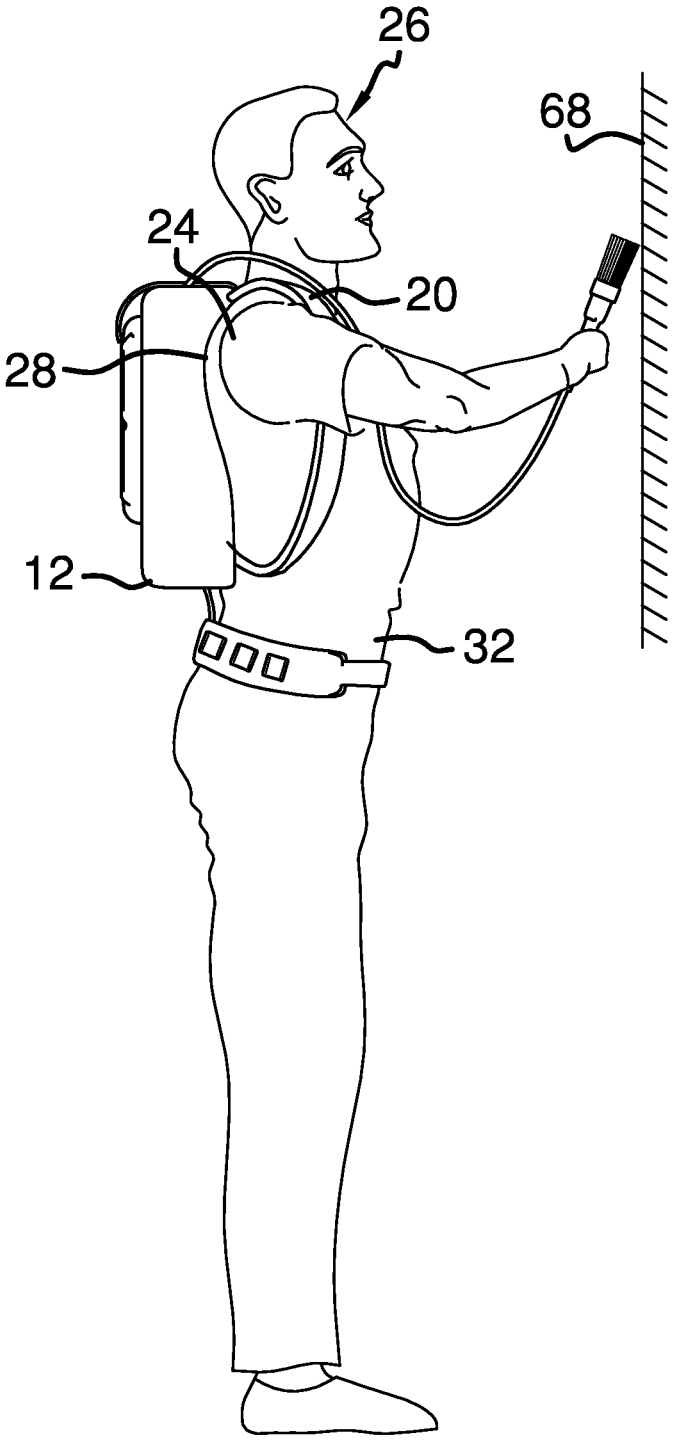
FIG. 5 is a right side in-use view of an embodiment of the disclosure.

With reference now to the drawings, and in particular to FIGS. 1 through 5 thereof, a new paint device embodying the principles and concepts of an embodiment of the disclosure and generally designated by the reference numeral 10 will be described.

As best illustrated in FIGS. 1 through 5, the paint application assembly 10 generally comprises a backpack 12 that has a back side 14, a bottom side 16 and a top side 18. The backpack 12 includes a pair of straps 20 coupled to the backpack 12 and a belt 22 coupled to the backpack 12. The straps 20 are positioned on the back side 14 and may be looped over shoulders 24 of a user 26, retaining the backpack 12 on a back 28 of the user 26. The belt 22 has a pair of ends 30 and the ends 30 of belt 22 are matable. The belt 22 is positioned on the bottom side 16 and the belt 22 may be wrapped around a waist 32 of the user 26. The top side 18 of the backpack 12 is open to access an interior of the backpack 12. A flap 36 is coupled to the top side 18 to selectively close the top side 18.

A paint application apparatus 38 is coupled to the backpack 12. The paint application apparatus 38 contains and selectively dispenses a paint 40. The paint 40 may be liquid paint of any conventional design. The paint application apparatus 38 comprises a bladder 42 positioned within the interior of the backpack 12 to contain the paint 40. The bladder 42 has a top side 41 and a bottom side 43. A pump 44 is in fluid communication with the bladder 42. The pump 44 is removable from the top side 41 of the bladder 14 to facilitate the bladder to be filled with the paint 40. The pump 44 may be an air pump or the like.

The pump 44 includes a pump hose 46 extending outwardly from the top side 18 of the backpack 12. The pump hose 46 has a distal end 48 with respect to the bladder 42. The pump hose 46 is removably coupled to one of the straps 20 such that the distal end 48 is accessible to the user 26 when the user 26 wears the backpack 12. The pump 44 includes a bulb 50 fluidly coupled to the distal end 48 of the pump hose 46 and the bulb 50 may be squeezed by the user 26. The bulb 50 urges air into the bladder 42 such that the pump 44 pressurizes the paint 40 in the bladder 42.

A brush hose 52 is fluidly coupled to the bottom side 43 of the bladder 42 and the brush hose 52 extends outwardly from the top side 18 of the backpack 12. The brush hose 52 has a distal end 54 with respect to the backpack 12. The brush hose 52 is removably coupled to one of the straps 20 such that the distal end 54 of the brush hose 52 is accessible to the user 26 when the user 26 wears the backpack 12. The brush hose 52 has a rigid portion 52A and a flexible portion 52B. The rigid portion 52A extends from the bladder 42 through the backpack 12. The flexible portion 52B is exposed outside of the backpack 12.

A brush 60 is provided that has a handle portion 62 and a bristle portion 64. The brush hose 52 extends upwardly through the handle portion 62 such that the distal end 54 of the brush hose 52 is positioned within the bristle portion 64. The brush hose 52 dispenses the paint 40 into the bristle portion 64 when the bulb 50 is squeezed. The brush 60 may comprise a paint brush or the like. A valve 66 is fluidly coupled between the brush hose 52 and the brush 60. The valve 66 selectively restricts a flow of the paint 40 through the brush hose 52.

In use, the backpack 12 is worn and the bladder 42 is filled with the paint 40. The valve 66 is placed in a closed position to restrict the flow of the paint 40 into the brush 60. The bulb 50 is repeatedly squeezed to pressurize the paint 40 in the bladder 42. The valve 66 is placed in an open position to allow the paint 40 to flow outwardly into the bristle portion 64. The brush 60 is used to apply the paint 40 to a surface 68. The valve 66 is opened and closed to regulate the amount of paint 40 that is released into the bristle portion 64.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A paint application assembly configured to transport and apply a liquid paint, said assembly comprising:

a backpack having a back side and a bottom side, said back pack including a pair of straps coupled to said backpack and a belt coupled to said backpack, said straps being positioned on said back side, said straps being configured to be looped over shoulders of a user, said backpack being configured to be retained on a back of the user, said belt being positioned on said bottom side, said belt being configured to be wrapped around a waist of the user; and a paint application apparatus coupled to said backpack, said paint application apparatus being configured to contain and selectively dispense a paint, said paint application apparatus including a bladder positioned within said backpack, said bladder having a top side and a bottom side, said bladder being configured to contain the paint;

a pump being in fluid communication with said bladder, said pump including a pump hose fluidly coupled to said pump, said pump hose extending outwardly from said top side of said backpack, said pump hose having a distal end with respect to said backpack, said pump hose being removably coupled to one of said straps such that said distal end is configured to be accessible to the user when the user wears said backpack, said pump including a bulb fluidly coupled to said distal end, said bulb being configured to be squeezed by the user, said bulb urging air into said bladder such that said pump is configured to pressurize the paint in said bladder; and a brush hose fluidly coupled to said bottom side of said bladder, said brush hose extending outwardly from said top side of said backpack, said brush hose having a distal end with respect to said backpack, said brush hose being removably coupled to one of said straps such that said distal end of said brush hose is configured to be accessible to the user when the user wears the backpack, said brush hose having a rigid portion and a flexible portion, said rigid portion extending from said bladder through said backpack, said flexible portion being exposed outside of said backpack.

2. A paint application assembly configured to transport and apply a liquid paint, said assembly comprising:

a backpack having having a back side and a bottom side said back pack including a pair of straps coupled to said backpack and a belt coupled to said backpack, said straps being positioned on said back side, said straps being configured to be looped over shoulders of a user, said backpack being configured to be retained on a back of the user, said belt being positioned on said bottom side, said belt being configured to be wrapped around a waist of the user;

a paint application apparatus coupled to said backpack, said paint application apparatus being configured to contain and selectively dispense a paint, said paint application apparatus comprising:

a bladder positioned within said backpack, said bladder having a top side and a bottom side, said bladder being configured to contain the paint;

a pump being in fluid communication with said bladder;

said pump including a pump hose fluidly coupled to said bladder, said pump hose extending outwardly from said top side of said backpack, said pump hose having a distal end with respect to said bladder, said pump hose being removably coupled to one of said straps such that said distal end is configured to be accessible to the user when the user wears said backpack;

said pump including a bulb fluidly coupled to said distal end of said pump hose, said bulb being configured to be squeezed by the user, said bulb urging air into said bladder such that said pump is configured to pressurize the paint in said bladder;

a brush hose fluidly coupled to said bottom side of said bladder, said brush hose extending outwardly from said top side of said backpack, said brush hose having a distal end with respect to said backpack, said brush hose being removably coupled to one of said straps such that said distal end of said brush hose is configured to be accessible to the user when the user wears the backpack, said brush hose having a rigid portion and a flexible portion, said rigid portion extending from said bladder through said backpack, said flexible portion being exposed outside of said backpack; and a brush having a handle portion and a bristle portion, said brush hose extending upwardly through said handle portion such that said distal end of said brush hose is positioned within said bristle portion, said brush hose being configured to dispense the paint into said bristle portion when said bulb is squeezed.

* * * * *